US006234766B1

(12) United States Patent
De Koning

(10) Patent No.: US 6,234,766 B1
(45) Date of Patent: May 22, 2001

(54) PUMP SYSTEM

(75) Inventor: Cornelis Johannes De Koning, Velden (NL)

(73) Assignee: Envirotech Pumpsystems Netherlands B.V., Venlo (NL)

( * ) Notice: Subject to any disclaimer, the term of this patent is extended or adjusted under 35 U.S.C. 154(b) by 0 days.

(21) Appl. No.: 09/331,767

(22) PCT Filed: Dec. 18, 1997

(86) PCT No.: PCT/NL97/00711

§ 371 Date: Jun. 24, 1999

§ 102(e) Date: Jun. 24, 1999

(87) PCT Pub. No.: WO98/28540

PCT Pub. Date: Jul. 2, 1998

(30) Foreign Application Priority Data

Dec. 24, 1996 (NL) ..... 1004890

(51) Int. Cl.[7] ..... F01B 23/08; F01B 9/08; F04F 11/00

(52) U.S. Cl. ..... 417/321; 92/387

(58) Field of Search ..... 417/321, 92, 53, 417/54, 387; 406/83, 86, 55, 112, 109, 96

(56) References Cited

U.S. PATENT DOCUMENTS

| | | | | |
|---|---|---|---|---|
| 4,378,183 | * | 3/1983 | Ackerman | 406/109 |
| 4,527,957 | | 7/1985 | Dettinger et al. | 417/92 |
| 4,834,589 | * | 5/1989 | Dietrich | 406/109 |
| 5,281,107 | * | 1/1994 | De Koning | 417/386 |
| 5,310,321 | * | 5/1994 | De Koning | 417/92 |

FOREIGN PATENT DOCUMENTS

| | | |
|---|---|---|
| 1453576 | 2/1969 | (DE) . |
| 3021851 | 12/1981 | (DE) . |
| 3310066 | 10/1984 | (DE) . |
| 0036945 | 10/1981 | (EP) . |
| 0048535 | 3/1982 | (EP) . |
| 1187912 | 4/1970 | (GB) . |
| 9001676 | 2/1992 | (NL) . |
| WO 80/01706 | 8/1980 | (WO) . |

* cited by examiner

*Primary Examiner*—Timothy S. Thorpe
*Assistant Examiner*—Michael K. Gray
(74) *Attorney, Agent, or Firm*—Pennie & Edmonds LLP

(57) ABSTRACT

A pump system suitable for pumping a hot medium, such as hot mixtures of liquid and solid substances (slurries), includes at least one displacement pump, such as a membrane pump, at least one bidirectional flow pipe, and a second pipe connected to the pump chamber of the displacement pump. The bidirectional flow pipe is connected at a first end to a first and a second one-way valve. A supply pipe for drawing an amount of medium from the supply pipe is connected to the bidirectional flow pipe via the first one-way valve and a discharge pipe for discharging an identical amount of medium from the bidirectional flow pipe is connected to the bidirectional flow pipe via the second one-way valve. The second pipe is provided in a horizontal plane. The displacement pump is associated with an expansion accommodating feature to allow the displacement pump to move when the bidirectional flow pipe or second pipe expand. A partition element is provided in the bidirectional flow pipe to restrict flow through the pipe.

24 Claims, 6 Drawing Sheets

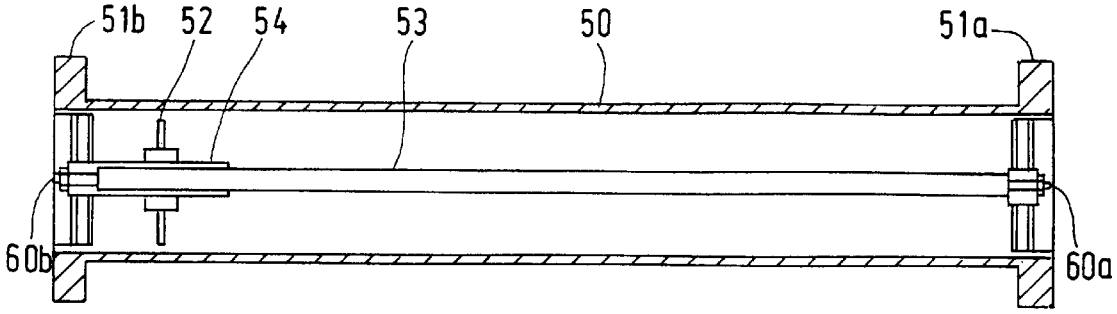
FIG. 6a
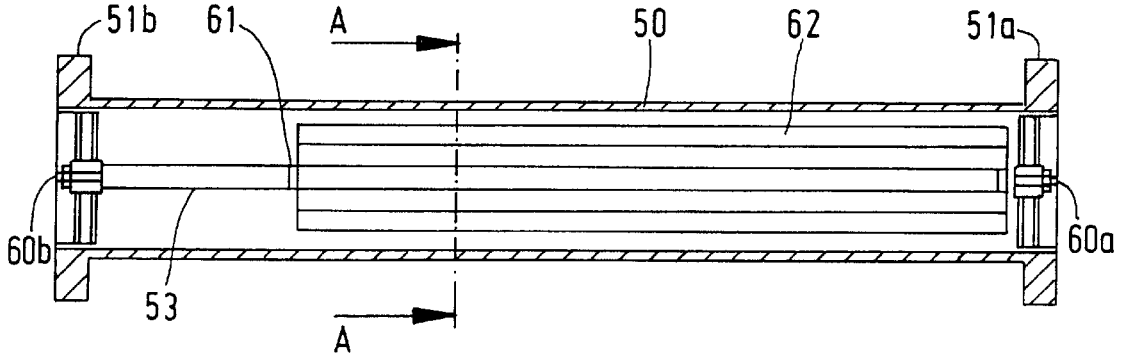
FIG.6b
FIG.6c
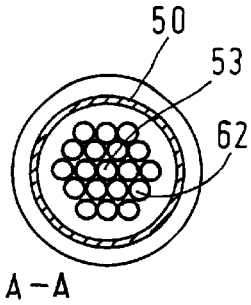

PUMP SYSTEM

FIELD OF THE INVENTION

The invention relates to a pump system in particular suitable for pumping hot media, such as hot mixtures of liquid and solid substances (slurries). The system includes at least one displacement pump, preferably a membrane pump, and at least one bidirectional flow pipe. The bidirectional flow pipe is connected to a first and second one-way valve at the first end of the pipe. The bidirectional flow pipe is connected at a first end via the first one-way valve, to a supply pipe for drawing an amount of medium from said supply pipe and is also connected on the first end via the second one-way valve, to a discharge pipe for discharging an identical amount of medium from said bidirectional flow pipe. The bidirectional flow pipe is connected on its other side to a second pipe, which is circumferentially is provided with heat exchange means. The second pipe is connected at its other end to a pump chamber of the displacement pump.

BACKGROUND OF THE INVENTION

A pump system of the above kind is disclosed in published Dutch patent application No. 90 01 676 in the name of the present applicant. The known pump system is used for pumping a hot slurry from a supply pipe to a discharge pipe. An amount of a hot mass is drawn into the bidirectional flow pipe by means of the displacement pump with every stroke. The hot mass is forced from the bidirectional flow pipe into the discharge pipe with the subsequent delivery stroke. The displacement volume of the displacement pump and the volume of the bidirectional flow pipe are thereby geared to each other in such a manner that the amount of medium drawn in and forced out fills the bidirectional flow pipe entirely or only partially. The bidirectional flow pipe is connected to the pump chamber via a second pipe having a liquid column present therein. The movements of the pump casing are thereby transmitted to the liquid mass in the bidirectional flow pipe by the liquid column in the second pipe. The hot medium in the bidirectional flow pipe is kept separated from the pump casing by the liquid column present in the second pipe. In order to maintain the temperature at the location of the pump casing at an acceptable level, heat exchange elements are provided around the second pipe. These elements cool the medium column present in the pipe. With this known embodiment of such a pump system, the second pipe extends in a vertical direction. The advantage of this is that it enables a limited construction volume. A drawback of the vertical arrangement of said second cooled pipe is, however, that an enhanced heat transport will occur in the direction of the displacement pump as a result of conduction, and especially as a result of the occurrence of a convection current in the pipe. On the one hand, this leads to a higher temperature at the pump casing, which is no longer acceptable under certain circumstances. On the other hand, it also leads to greater heat losses, because a larger amount of heat must be removed by cooling. With slurry temperatures on the order of 150 C. these problems are still acceptable, but at higher medium temperatures, as will increasingly occur in the future, this leads to very large cooling capacities and a corresponding cooling water consumption in order to keep the temperature at the pump casing at an acceptable level. Furthermore this leads to large heat losses of the medium to be pumped, which is also disadvantageous from an energy point of view.

Another drawback of this known system is its very large construction height, which leads to very heavy concrete bases required for these systems. Furthermore, a high pressure of the medium in the supply pipe is necessary with these systems in order to overcome the pressure of the static liquid column in the vertical portion.

Another embodiment of a pump system as described above is known from EP-A-0048535. Also with this known pump system a vertical pipe is present between the bidirectional flow pipe and the pump device. The vertical pipe contains a medium column for transmitting the piston movements, whereby heat and mass transport in the direction of the pump device will again occur in this pipe as a result of conduction and convection. As a result of this, excessive temperatures will occur at the pump casing, especially with higher temperatures of the medium to be pumped, and a large amount of heat will have to be removed by cooling, which is disadvantageous from an energy point of view.

From PCT/US79/00697, a system is furthermore known wherein the inlet and outlet valves and the bidirectional flow pipe are positioned higher than the displacement pump. As a result, the direction of the convection current has a positive effect on heat transport, but the systems are only suitable for non-settling liquids, and certainly not for slurry suspensions, for which the present invention is particularly intended.

The object of the invention is to provide a pump system of the kind indicated above, wherein the aforesaid drawbacks are obviated and by means of which high-temperature media can be pumped without this leading to excessively high temperatures at the displacement pump and without having to remove an excessive amount of heat in the second pipe by cooling.

SUMMARY OF THE INVENTION

In order to accomplish that objective the pump system according to the invention is characterized in that at least the second pipe is accommodated in a substantially horizontal plane in the system. The result of this surprisingly simple measure is that the heat and mass transport caused by convection currents in the second pipe have been reduced to a minimum. As a result of this, the temperature at the end of the second pipe remote from the bidirectional flow pipe can have a relatively low value. Also at high media temperatures cooling of the second pipe is not required. Another advantage is the fact that the amount of heat that has to be removed in the second pipe by cooling will be limited, which is attractive from an energy point of view.

An advantageous embodiment of the pump system includes a said second pipe that extends at an angle to the bidirectional flow pipe in the horizontal plane, whereby the two pipes are interconnected via a bent pipe. In this manner, the pipes may expand, which is caused by the fact that the temperature during assembly is much lower than during operation. Expansion is accommodated because the two pipes can bend slightly outwards, as a result of which the expansion can readily be accommodated in the device. In another embodiment of the pump system according to the invention, expansion differences can be accommodated by connecting the second pipe to the displacement pump at its end remote from the bidirectional flow pipe via a bend and another pipe. This further increases the flexibility of the system of pipes.

Another advantageous embodiment of the pump system according to the invention is characterized in that the second pipe and the bidirectional flow pipe, which likewise extends horizontally, are coaxially aligned, whereby the displacement pump is movably accommodated in the system in such a manner that the displacement pump can move under the influence of changes in length of the two pipes caused by changes in temperature. With this embodiment, the part of the system housing that contains the one-way valves, which can be connected to the supply pipe and the discharge pipe, can be fixedly disposed. Expansion of the two pipes causes them to exert such a force on the displacement pump that the pump will move as a result thereof.

According to another embodiment, it is also possible to use driving means, which move the pump device under the influence of temperature and/or expansion signals, rather than transmit the forces that occur during expansion of the two pipes to the displacement pump via the pipes.

In another embodiment of the pump system the bidirectional flow pipe and the second pipe are interconnected in coaxially aligned relationship, and their common axis exhibits a curved configuration. In this embodiment, any expansion differences caused by temperature changes will manifest themselves in the two pipes exhibiting a sharper or a wider bend.

According to another embodiment, in order to obtain a compact construction, the pump of the pump system is accommodated in the system in such a manner that the central axis of the pump extends substantially parallel to the central axis of the second pipe.

In another embodiment, the pump system includes a partition element that is disposed in the bidirectional flow pipe. The partition element at least partially shuts off the passage through the pipe. The partition element impedes the transport of the hot and frequently corrosive medium in the direction of the pump casing and the membrane pump to a considerable degree. In this manner the load on the device as a whole is reduced, demands on the individual components are reduced and a simpler and cheaper construction of the device is made possible.

The partition element may be capable of free reciprocating movement in the direction of the axis of the pipe, and in particular be slidably mounted on a guide bar disposed in line with the central axis of the bidirectional flow pipe. This prevents unnecessary influencing of the pumping action.

According to the invention the partition element may be provided with a number of through channels, which function to prevent any unnecessary negative influencing of the pumping action. The transport of the medium in the direction of the pump casing and the membrane pump can also be impeded by configuring the partition element as a disc-shaped element having a diameter which is smaller than the diameter of the bidirectional flow pipe, or as an elongated element.

In addition, the second pipe may be provided at the location of the heat exchange means with means which have a mixing effect on the medium present at that location, such that the medium will be placed into proper heat exchanging contact with the pipe wall. This leads to an enhanced cooling effect of the heat exchange means on the hot medium.

BRIEF DESCRIPTION OF THE DRAWINGS

The invention will be explained in more detail hereafter with reference to the drawing, which shows a few embodiments of a pump system according to the invention.

FIGS. 6*a* and 6*b* are detailed views of other embodiments for use in the pump system according to the invention.

FIG. 6*c* is a cross section taken along line A—A of FIG. 6*b*.

DETAILED DESCRIPTION

Figure 1:
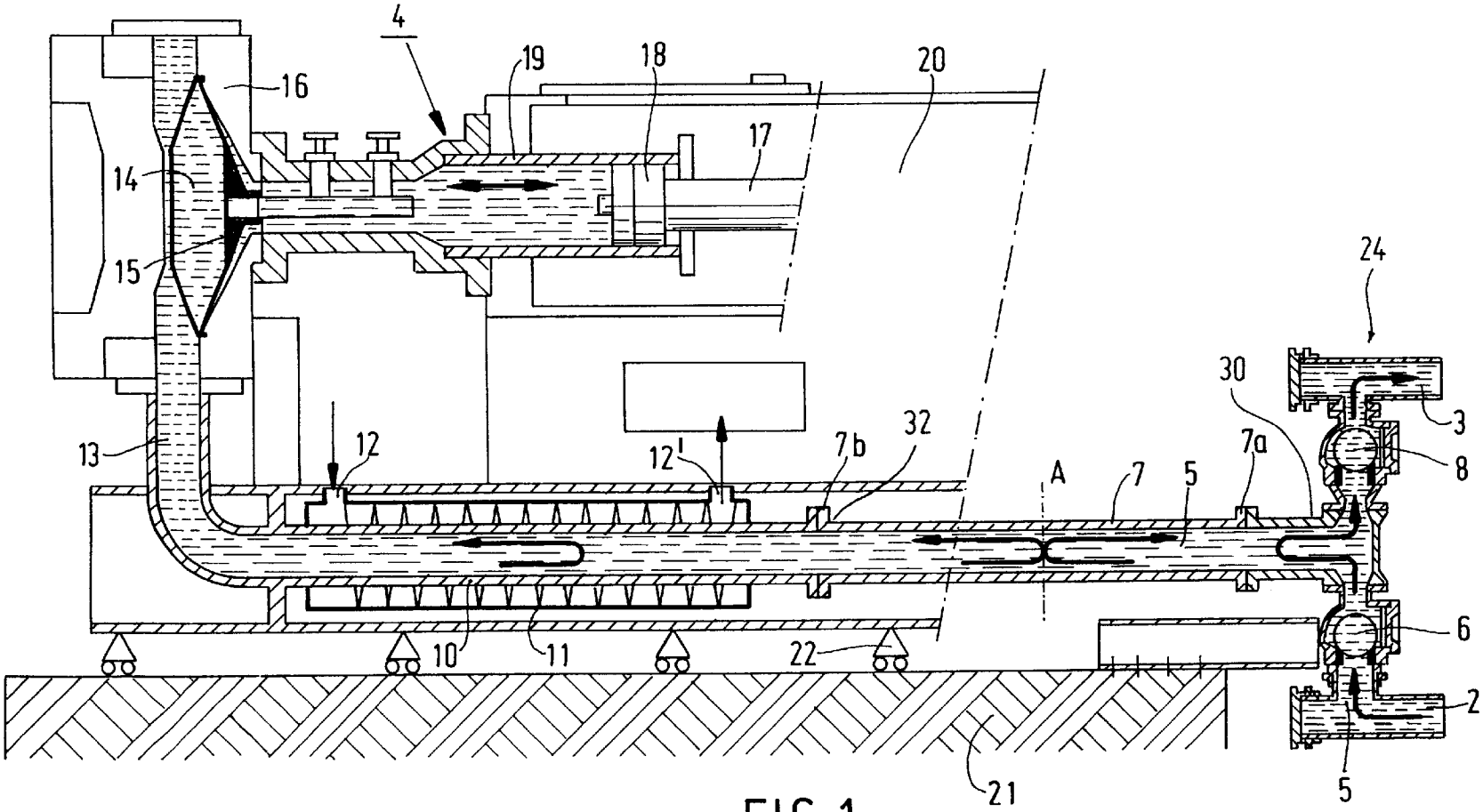
FIG. 1 shows a diagrammatic view, not to scale, of a pump system for pumping hot media.

FIG. 1 shows a pump system comprising a supply pipe 2 and a discharge pipe 3. The pump system furthermore comprises a displacement pump 4 (partially shown) for drawing in a medium 5, for example a slurry, from supply pipe 2, via a first one-way valve 6, into a generally horizontally disposed bidirectional flow pipe 7. The drawing in of medium 5 takes place in a suction phase, which is followed by a delivery phase, in which the medium 5, which has collected in bidirectional flow pipe 7, is forced into a discharge pipe 3 connected thereto via a second one-way valve 8. The two one-way valves 6 and 8 used in the illustrated embodiment are ball valves and are positioned in valve casing 24. It is also possible, however, to use other types of one-way valves, such as conical valves, ring valves or flat valves. Valve 6 is open and valve 8 is closed during the suction phase, whilst valve 6 is closed and valve 8 is open during the delivery phase.

Letter A indicates the point of reversal or the boundary layer in bidirectional flow pipe 7 that indicates the point to which the sucked-in medium 5 enters bidirectional flow pipe 7 before being removed therefrom again.

On its side remote from the valves bidirectional flow pipe 7 is connected to a horizontally extending pipe 10, which is surrounded by a heat exchanger 11, through which a cooling medium is passed from inlet 12 to outlet 12'. As shown in FIG. 1, the first 6 and second 8 one-way valves are attached to the bidirectional flow pipe 5 at a first end 30 of the pipe 5. On the other end of pipe 5, at second end of 32, second pipe 10 is connected, via a bent pipe 13, to the pump chamber 14 of a membrane pump 4. Membrane pump 4 possesses a membrane 15 disposed in a pump casing 16 to which pipe 13 is connected. The membrane pump is provided with a piston rod 18, which is reciprocated by driving means (not shown). Attached to piston rod 17 is a displacement member 18, which is capable of movement within a cylinder 19. Piston rod 17 may reciprocate membrane 15 directly, if desired, but the reciprocation may also be effected via an intermediate medium shown in the figure, which is reciprocated by displacement member 18 and which transmits said reciprocating movement to membrane 15. The reciprocating movement of membrane 15 results in the suction phase and the delivery phase, as a result of which medium 5 is transported from supply pipe 2 to discharge pipe 3. The hot medium 5 reciprocating through bidirectional flow pipe 7 is thereby separated from membrane by the column of medium present in second pipe 10. As a result of the horizontal arrangement of both bidirectional flow pipe 7 and second pipe 10, transport of heat from medium in the direction of membrane 15 is only possible to a very limited extent, namely via conduction and a small amount of admixing caused by turbulence. The small amount of heat is thereby removed from pipe 10 by cooling via heat exchange means 11, so that membrane 15 will not be exposed to high temperatures. Due to the horizontal arrangement of the two pipes there will be hardly any heat transport, if at all, from the hot medium 5 present in bidirectional flow pipe 7 via convection current. In this manner a pump system has been obtained which is also capable of pumping media having very high temperatures, without exposing membrane 15 to excessively high temperatures thereby. Since the temperature of the two pipes 7 and 10 during assembly will be much lower than the temperatures that occur during operation of the pump system, the two pipes will exhibit expansion. Since it is generally desirable, for practical reasons, for the valve casing 24 comprising valves 6 and 8 to be fixedly disposed, because valve casing 24 is connected to supply and discharge pipes 2 and 3, which form part of a larger, fixedly disposed installation, it will be necessary to accommodate the expansion of pipes 7 and 10 on the other side. In order to accommodate the expansions, displacement pump block 20 of the pump system according to the invention is disposed on foundation 21 with the interposition of a guide 22, over which displacement pump block 20 can move. The guide may also be a friction guide, but it is also possible to place block 20 on a roller guide 22, over which a slight movement of the block is possible in case of expansion of pipes 7 and 10. The forces required for moving block 20 are thereby transmitted to the pump block by pipes 7 and 10 themselves. As will be explained hereafter, it is also possible to design the system of pipes 7 and 10 to have a certain flexibility.

In the embodiment shown in FIG. 1, the displacement pump is a membrane pump, which may either be a single-acting pump or a double-acting pump. In the case where the pump is a double-acting pump, an intermediate medium will be present to the right of displacement member 18, which intermediate medium is capable of moving a membrane (not shown) and operating another pump system. Instead of using a membrane pump it is also possible to use ordinary displacement pumps, and the pump system may comprise several such displacement pumps.

Generally, the displacement volume of the displacement pump will be smaller than the interior volume of bidirectional flow pipe 7, so that the boundary layer A will remain within bidirectional flow pipe 7. The extent to which the displacement volume will be smaller thereby depends on a factor which is determined empirically and, given the temperature of the slurry, on the basis of the Reynolds number. Generally, the factor will range between 1.05 and 5, in practice.

As is shown in FIG. 1, the displacement pump is disposed in the illustrated pump system in such a manner that the central axes of the rods extend parallel to second pipe 10. This has resulted in a highly compact construction of the pump system.

The figures to be discussed hereafter show a number of possible arrangements of pump systems according to the invention. All these arrangements comprise as common elements, which are consequently indicated by the same numerals in the various figures, a pump unit 20, which in this embodiment comprises four displacement pumps, which are each provided with a pump chamber 14. The pump unit is thereby disposed on a foundation 21. Furthermore each of these embodiments comprises four valve casings 24 housing valves 6 and 8, which are connected to a supply pipe 2 and a discharge pipe 3, respectively.

Figure 2A:
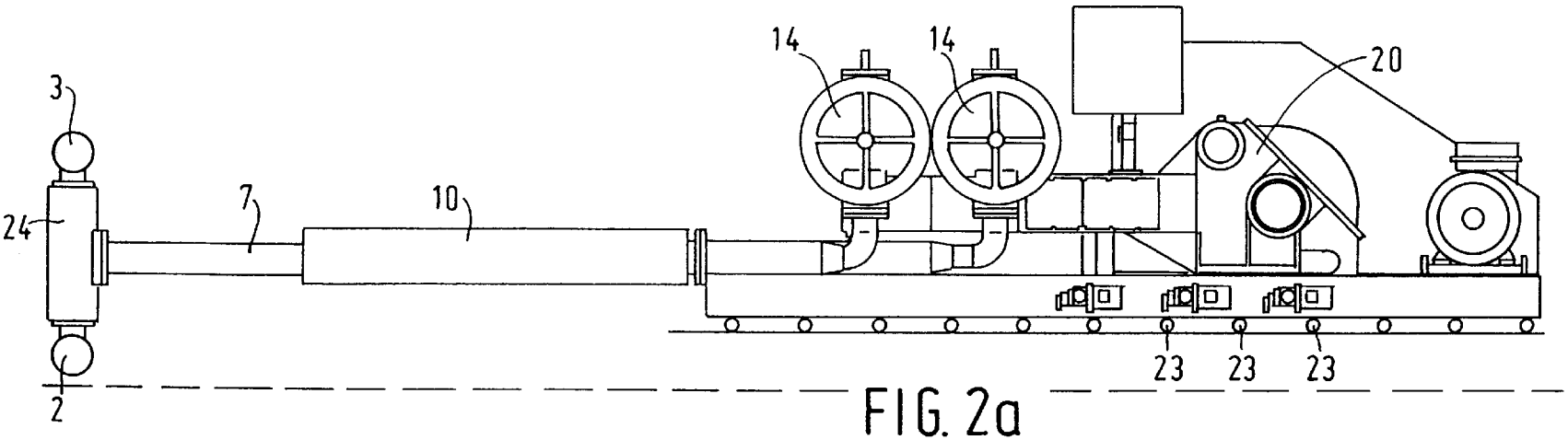
FIGS. 2*a* and 2*b* show a side view and a plan view respectively of a pump system, wherein the bidirectional flow pipe and the second pipe are horizontally in line.
Figure 2B:
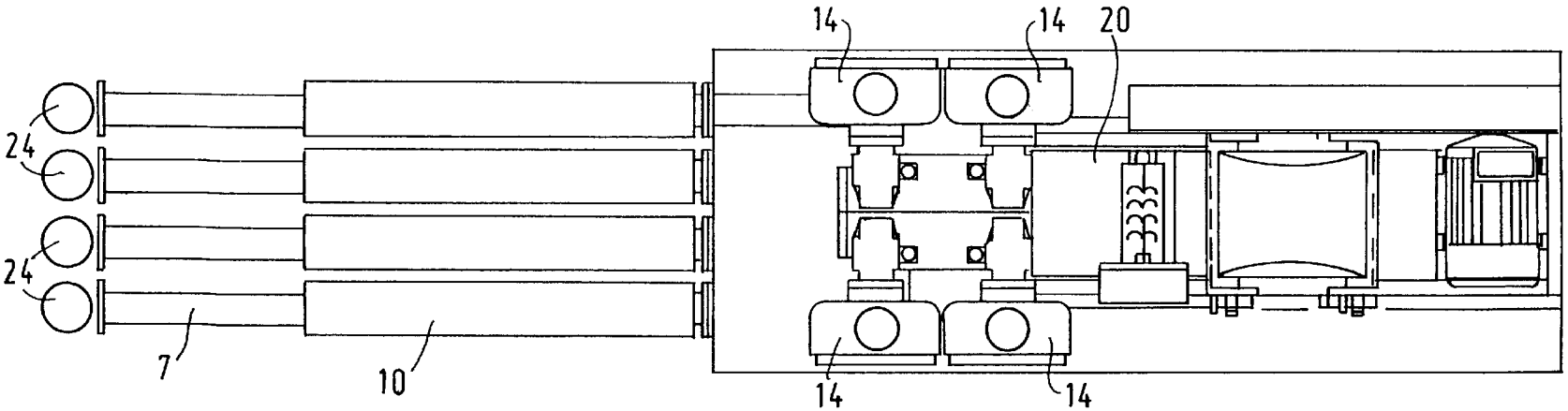

In the embodiment shown in FIGS. 2*a* and 2*b*, bidirectional flow pipe 7 and second pipe 10 are disposed in coaxially aligned relationship between valve casings 24 on the one hand and pump unit 20 on the other hand. Valve housings 24 are fixedly disposed thereby, and pump unit 20 is disposed on foundation 21 via roller guides 23 so as to accommodate expansion differences between pipes 7 and 10 caused by temperature differences. If expansion differences occur in pipes 7 and 10, the pipes will move the pump unit a small distance, thus accommodating the expansion differences.

Figure 3A:
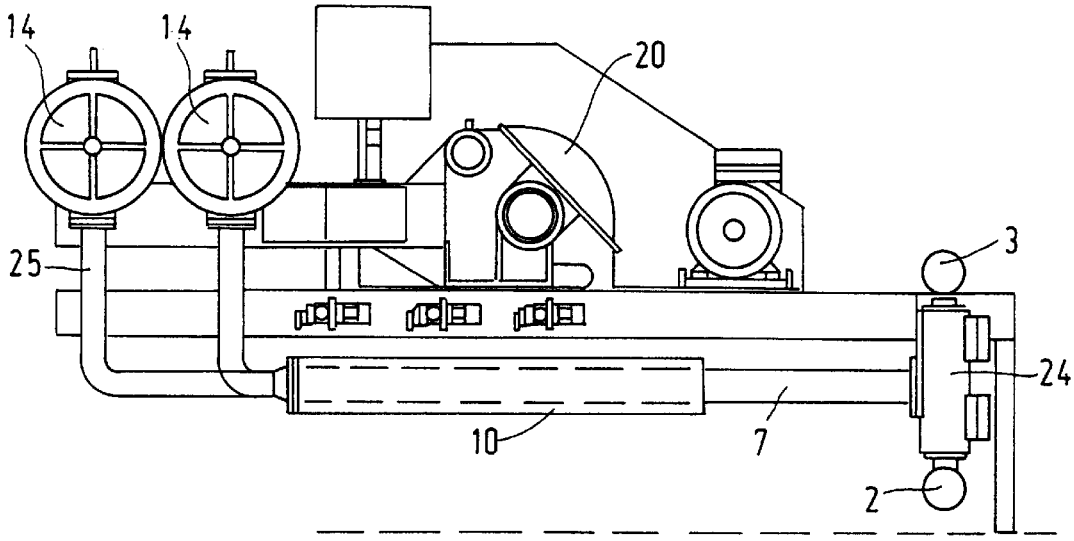
FIGS. 3*a* and 3*b* and FIGS. 4*a* and 4*b* each show an embodiment, in side view and in plan view respectively, of the pump system according to the invention.
Figure 3B:
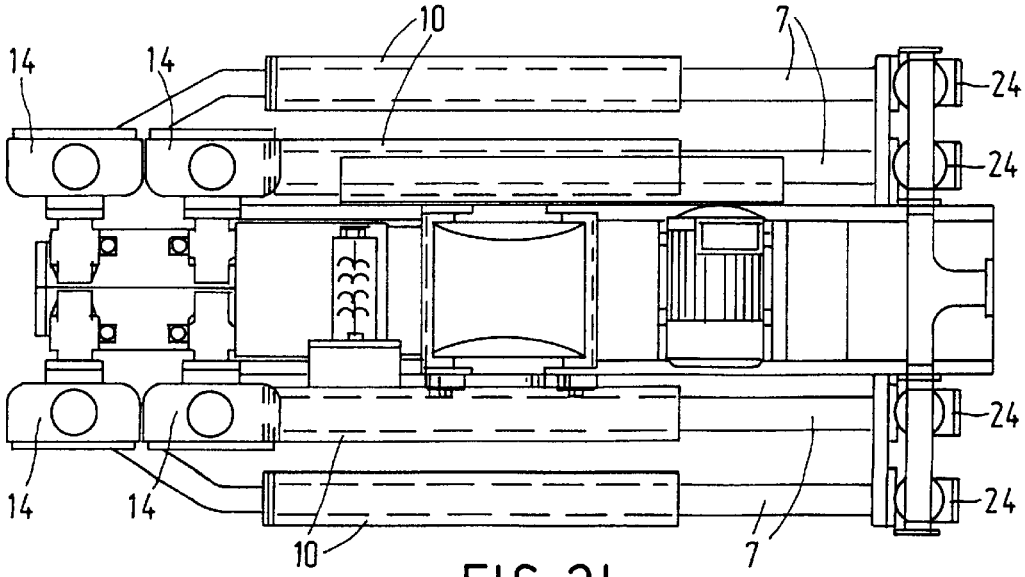

FIGS. 3*a* and 3*b* show another possible embodiment, which in principle corresponds with the embodiment which is diagrammatically shown in FIG. 1. In FIGS. 3*a* and 3*b*, pipes 7 and 10 extend between valve casings 24 and pump chambers 14 in such a manner that pipe 10 extends parallel to pump unit 20. This leads to a compact construction of the pump system. Pipe is connected to pump chamber 14 via a pipe 25, which extends at an angle to pipe 10. This arrangement has resulted in a certain amount of flexibility in the pipe system, as a result of which expansion differences occurring in pipes 7 and 10 can at least partially be compensated. Although pipe 25 is a straight pipe in this embodiment, it may also be configured as a large bend connected to pump chamber 14 on one side and to pipe 10 on the other side, whilst still retaining its advantages.

Figure 4A:
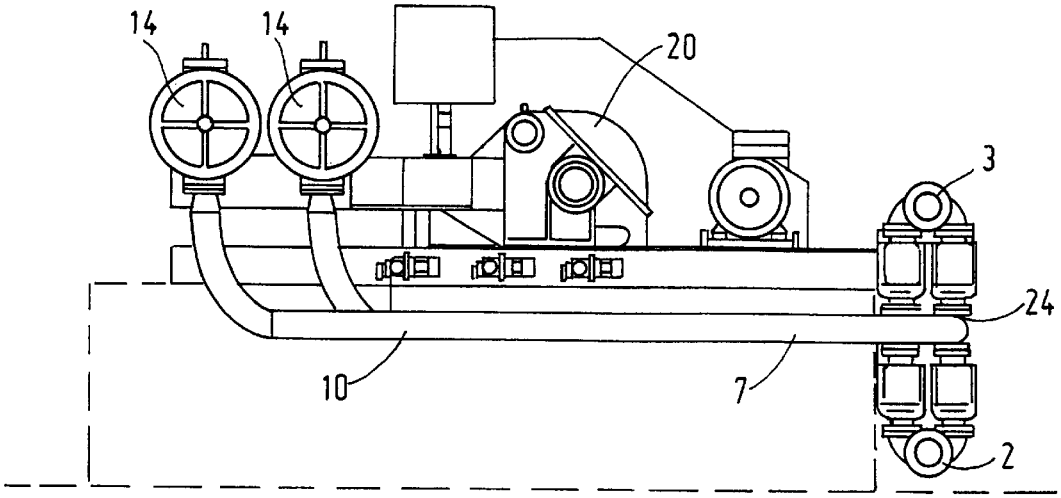
Figure 4B:
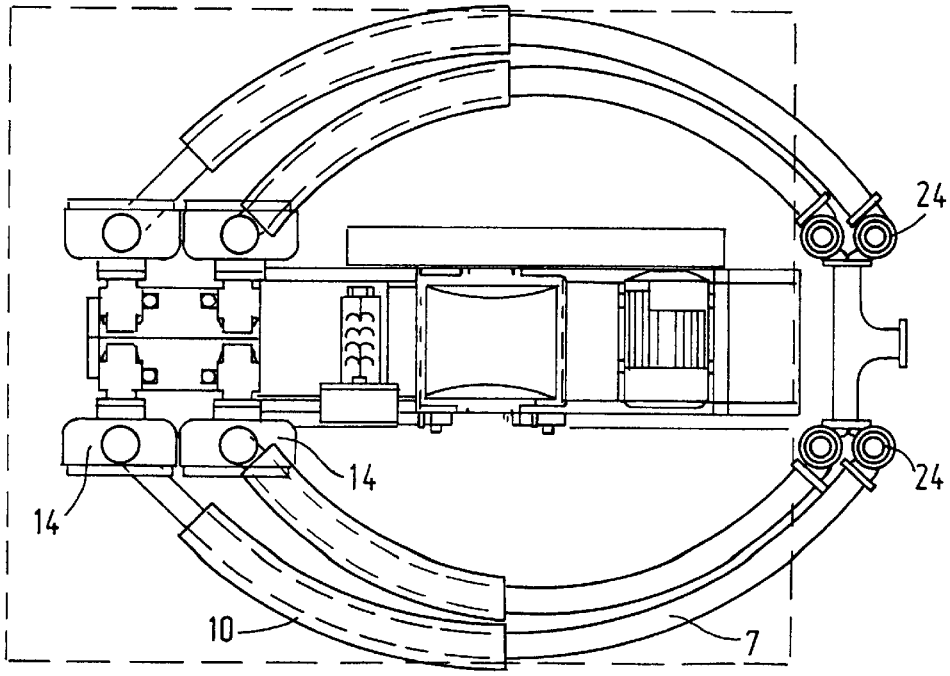

Another possibility of accommodating expansion differences in pipes 7 and 10 is shown in FIGS. 4*a* and 4*b*, wherein pipes 7 and 10 connect to one another in coaxially aligned relationship, but wherein said pipes are substantially arcuate or bent between valve casings 24 and pump chambers 14. As a result of this bent configuration, expansion differences in pipes 7 and 10 will cause the bend or curve in the pipes to become sharper or wider, thus accommodating expansion differences in the pipes.

The possibilities of accommodating expansion differences in the system of pipes are by no means limited to the possibilities that have been discussed above, of course, with several other configurations being possible. Thus it is, for example, possible to have pipes 7 and 10 extend at an angle to each other in the horizontal plane as well.

In the above, a possibility of slidably mounting pump block 20 on its foundation in order to accommodate expansions in pipes 7 and 10 has been discussed, whereby pipes 7 and 10 transmit the expansion forces to pump block 20 themselves, as a result of which the block is slightly moved. On the other hand, it is also possible to activate driving means by means of a temperature signal or an expansion signal. The driving means will move pump block 20 over a certain distance, which is determined on the basis of the signal being delivered.

Figure 5:
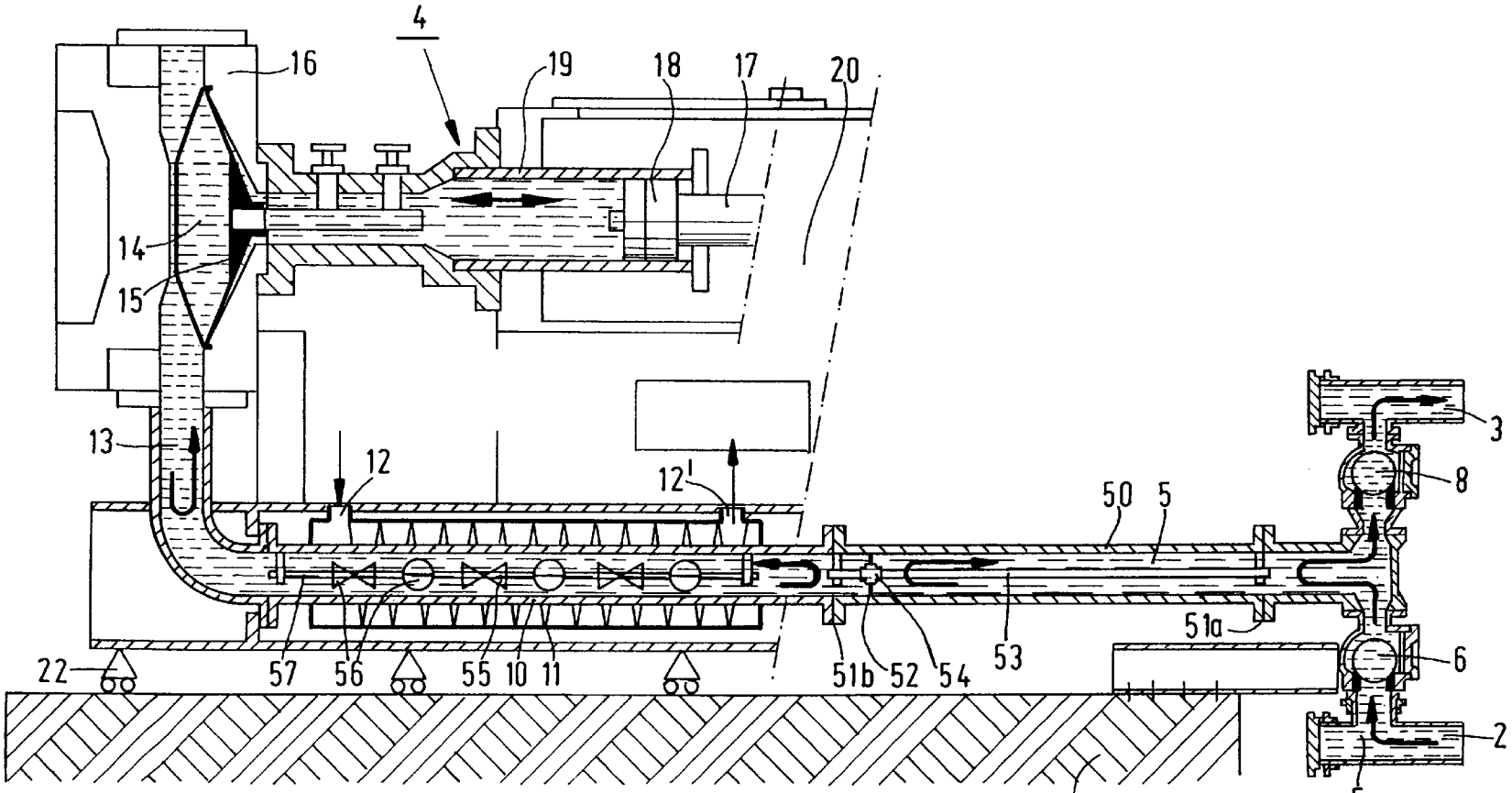
FIG. 5 shows another embodiment of the pump system according to the invention.

FIG. 5 shows another embodiment of a pump system according to the invention. The parts shown in this figure are numbered the same as in FIG. 1. Bidirectional flow pipe 7 of this pump system is provided with an intermediate pipe 50, which is connected to pipe 10 by means of a flange 51*b*, and which is connected to supply and discharge pipes 2 and 3 by means of a flange 51*a*. Analogously to what is shown in FIG. 1, intermediate pipe 50 normally forms part of bidirectional flow pipe 7, in which medium 5 collects. The embodiment of the pump system as shown includes a partition element 52 in the intermediate pipe 50 (also called bidirectional flow pipe 1). The partition element 52 can freely reciprocate in the direction of the axis of intermediate pipe 50. To this end, partition element 52 is provided with guides 54, and it is slidably mounted on a guide bar 53 extending along the central axis of intermediate pipe 50. The guide bar 53 is connected to intermediate pipe 50 near flanges 51*a* and 51*b*, in a manner which is known, but which is not shown.

The freely movable partition element 52 forms a more or less physical partition in bidirectional flow pipe 7, and impedes to a considerable extent transport of the hot and frequently corrosive medium 5 in the direction of pump casing 16. It has become apparent that the hot medium 5 moves slowly in the direction of pump casing 15 as a result of the periodic suction and delivery phases of membrane 15. Thus, the placing of partition element 52 provides additional protection of the pump casing and membrane 15, whilst it furthermore prevents unnecessary loading of heat exchanger 11.

This arrangement makes it possible to lower the requirements that are made of heat exchanger 11, thus enabling a simpler and cheaper construction thereof. Furthermore, pump casing 16 and in particular membrane will be loaded to a much smaller extent by the hot medium 5, as a result of which the life of these components is considerably prolonged. Consequently, the requirements made of the construction may be lowered as well, which enables a cheaper overall installation.

Another aspect of the invention is indicated at 55. Numeral 55 indicates mixing means, which are placed in pipe at the location of heat exchanger 11. In this embodiment the mixing means 55 consist of a large number of blades 56, which are mounted on a shaft 57 extending along the central axis of pipe 10. Alternatively, the blades 56 may be mounted on the inner wall of pipe 10. The mixing means have a mixing effect on medium 5, such that medium 5 is placed into proper heat-exchanging contact with the wall of pipe 10 of heat exchanger 11. The mixing action of the mixing means consists primarily of increasing the flow turbulence of medium 5 in pipe 10, which functions to increase the contact between heat exchanger 11 and the hot medium and thus obtain a greater cooling effect on hot medium 5. In particular, if medium 5 exhibits a flow behavior with predominantly low flow velocities, the static mixing means 55 will increase the turbulence of the hot medium considerably, thus increasing the cooling effect which heat exchanger 11 has on the medium.

FIGS. 6*a* and 6*b* show two embodiments of the partition element according to the invention. The two figures show intermediate pipe 50, which can be fitted into bidirectional flow pipe 7 of FIG. 5 by means of flanges 51*a* and 51*b*. Analogously to FIG. 5, FIG. 6A shows a guide bar 53, which is disposed along the central axis of intermediate pipe 50, and which is fixedly connected at its ends 60*a* and 60*b* to flanges 51*a* and 51*b* respectively in a manner which is known per se. A partition element 52 provided with suitable guide means bar 54 is mounted over the guide bar 53 in a manner which allows free reciprocating movement. Partition element 52 at least partially shuts off the passage through intermediate pipe 50. In the embodiment shown in FIG. 6*a*, partition element 52 is configured as a disc-shaped element having a diameter which is smaller than the diameter of pipe 50. The disc-shaped element is preferably made of a flexible, heat and corrosion resistant rubber material, so as not to affect the pumping action of the membrane pump, in particular when the pump system is being started. FIG. 6*b* shows another embodiment of the partition element according to the invention. Analogously to FIG. 6*a*, a guide bar 53 is mounted along the central axis of intermediate pipe 50, which guide bar is fixedly connected at its ends 60*a* and 60*b* to flanges 51*a* and 51*b* respectively in a manner which is known per se. Partition element 61 of this embodiment is elongated, however, and is built up of a number of through channels 62, which are arranged in a row around guide bar 53. This is shown in section A—A of FIG. 6*b*. Unlike the embodiment shown in FIG. 6*a*, the partition element 61 of this embodiment is not capable of free reciprocating movement, but it is fixedly mounted on guide bar 53.

The presence of channels 62 allows hot medium to pass in the direction of heat exchanger 11 and pump casing 16. During the suction phase of the membrane pump, the medium flowing in will exhibit a turbulent flow behavior, which turbulence is converted into a laminar flow by channels 62. As a result of this, the convection of heat in the direction of heat exchanger 11 and pump casing 16 (and membrane 15) will decrease considerably, and the constructional demands to be made of heat exchanger 11 and pump casing 16 may be lowered.

This makes it possible to achieve a simpler and cheaper construction.

It will be apparent that also the disc-shaped element 52 shown in FIG. 6*a* may be provided with a number of through channels. The partition element may be configured in the form of a sphere, which is provided in pipe 50 in a manner which allows free reciprocating movement. Also a brush-shaped element provided with a large number of protrusions will be satisfactory.

What is claimed is:

1. A pump system for pumping a hot medium comprising:

at least one displacement pump, and at least one bidirectional flow pipe, said bidirectional flow pipe having first and second ends and being connected at the first end, via a first one-way valve, to a supply pipe for drawing an amount of a medium from said supply pipe, and also being connected, via a second one-way valve, to a discharge pipe for discharging an identical amount of the medium from said bidirectional flow pipe, said bidirectional flow pipe being connected at the second end to a second pipe, which is provided with a heat exchange mechanism, with said second pipe being connected at its other end to a pump chamber of the displacement pump, wherein at least the second pipe is accommodated in a substantially horizontal plane in the system and an expansion accommodating feature is associated with the displacement pump such that said displacement pump is movable under the influence of changes in length of one or both of the second pipe and bidirectional flow pipe.

2. A pump system according to claim 1, wherein the expansion accommodating feature is a driving mechanism configured and dimensioned to respond to temperature or expansion changes of one or both of the second pipe and bidirectional flow pipe.

3. A pump system according to claim 1, wherein said second pipe extends at an angle to the bidirectional flow pipe in said horizontal plane, whereby the two pipes are interconnected via a bent pipe.

4. A pump system according to claim 1, wherein said second pipe is connected to the displacement pump with its side remote from the bidirectional flow pipe via a bent pipe.

5. A pump system according to claim 1, wherein both said second pipe and the bidirectional flow pipe extend horizontally and are coaxially aligned.

6. A pump system according to claim 1, wherein said bidirectional flow pipe and said second pipe are interconnected in a coaxially aligned relationship, with their common axis exhibiting a curved configuration.

7. A pump system according to claim 1, wherein the pump is accommodated in the system in such a manner that the central axis of the pump extends substantially parallel to the central axis of the second pipe.

8. A pump system according to claim 1, wherein a partition element is disposed in the bidirectional flow pipe, which partition element at least partially shuts off the passage through said pipe.

9. A pump system according to claim 8, further comprising a movement mechanism associated with said partition element for providing free reciprocating movement of the partition element inside the bidirectional flow pipe.

10. A pump system according to claim 9, wherein said partition element is slidably mounted on a guide bar disposed in line with the central axis of the bidirectional flow pipe.

11. A pump system according to claim 8, wherein said partition element is provided with at least one through channel.

12. A pump system according to claim 8, wherein the partition element is a disc-shaped element having a diameter which is smaller than the diameter of the bidirectional flow pipe.

13. A pump system according to claim 8, wherein said partition element is an elongated element.

14. A pump system according to claim 1, wherein the second pipe includes a mixing mechanism which has a mixing effect on the medium present therein, such that the medium will be placed into proper heat exchanging contact with the second pipe wall.

15. The pump system of claim 1, wherein the displacement pump is a membrane pump.

16. The pump system of claim 2, wherein the driving mechanism is a plurality of roller guides.

17. A pump system for pumping a hot medium comprising: at least one displacement pump, and at least one bidirectional flow pipe, said bidirectional flow pipe having first and second ends and being connected at the first end, via a first one-way valve, to a supply pipe for drawing an amount of a medium from said supply pipe, and also being connected, via a second one-way valve, to a discharge pipe for discharging an identical amount of the medium from said bidirectional flow pipe, said bidirectional flow pipe being connected at the second end to a second pipe, which is provided with a heat exchange mechanism, with said second pipe connected at its other end to a pump chamber of the displacement pump, wherein a partition element is disposed in the bidirectional flow pipe, which partition element is configured and dimensioned to at least partially shut off the passage through said pipe, thereby limiting the transfer of heat from the hot medium at one side of the partition element to the other side thereof.

18. A pump system according to claim 17, further comprising a movement mechanism associated with said partition element for providing free reciprocating movement of the partition element inside the bidirectional flow pipe.

19. A pump system according to claim 18, wherein said partition element is slidably mounted on a guide bar disposed in line with the central axis of the bidirectional flow pipe.

20. A pump system according to claim 17, wherein said partition element is provided with at least one through channel.

21. A pump system according to claim 17, wherein the partition element is a disc-shaped element having a diameter which is smaller than the diameter of the bidirectional flow pipe.

22. A pump system according to claim 17, wherein said partition element is an elongated element.

23. A pump system for pumping a hot medium comprising:

at least one displacement pump;

at least one bidirectional flow pipe, said bidirectional flow pipe having first and second ends, with first and second one-way valves being positioned at the first end, said bidirectional flow pipe connected to both a supply pipe for drawing in an amount of medium and a discharge pipe for discharging an amount of medium, with the first one-way valve being positioned between the bidirectional flow pipe and the supply pipe and the second one-way valve being positioned between the bidirectional flow pipe and the discharge pipe; and a second pipe connected to the second end of the bidirectional flow pipe at one end and to the displacement pump at the other end, said second pipe being associated with a heat exchanging mechanism, wherein at least the second pipe is accommodated in a substantially horizontal plane in the system.

24. A pump system for pumping a hot medium comprising:

at least one displacement pump;

at least one bidirectional flow pipe, said bidirectional flow pipe having first and second ends, with first and second one-way valves being positioned at the first end, said bidirectional flow pipe connected to both a supply pipe for drawing in an amount of medium and a discharge pipe for discharging an amount of medium, with the first one-way valve being positioned between the bidirectional flow pipe and the supply pipe and the second one-way valve being positioned between the bidirectional flow pipe and the discharge pipe;

a second pipe connected to the second end of the bidirectional flow pipe at one end and to the displacement pump at the other end, said second pipe being associated with a heat exchanging mechanism; and an expansion accommodating feature associated with the displacement pump such that said displacement pump is movable under the influence of changes in length of one or both of the second pipe and the bidirectional flow pipe.

* * * * *